US005303440A

United States Patent [19]

Zimmer

[11] Patent Number: 5,303,440

[45] Date of Patent: Apr. 19, 1994

[54] PROCESS FOR APPLYING, IMPRESSING OR REMOVING LIQUIDS OR SUBSTANCES

[76] Inventor: Johannes Zimmer, Ebentaler Str. 133, A-9020 Klagenfurt, Austria

[21] Appl. No.: 847,029

[22] PCT Filed: Aug. 14, 1991

[86] PCT No.: PCT/AT91/00094

§ 371 Date: Apr. 3, 1991

§ 102(e) Date: Apr. 13, 1992

[87] PCT Pub. No.: WO92/03605

PCT Pub. Date: Mar. 5, 1992

[30] Foreign Application Priority Data

Aug. 16, 1990 [AT] Austria ..... 1702/90

[51] Int. Cl.[5] ..... D06B 5/08

[52] U.S. Cl. ..... 8/151; 68/205 R

[58] Field of Search ..... 100/73; 8/151; 68/205 R, 202, 43; 118/206, 247; 101/116

[56] References Cited

U.S. PATENT DOCUMENTS

| | | | |
|---|---|---|---|
| 2,963,893 | 12/1960 | Kusters | 64/83 |
| 3,113,890 | 12/1963 | Johnson | 118/247 X |
| 3,245,377 | 4/1966 | Gettel | 118/249 X |
| 3,552,353 | 1/1971 | Labombarde | 118/240 X |
| 3,630,835 | 12/1971 | Busch | 162/184 |
| 3,735,733 | 5/1973 | Henc | 118/261 |
| 3,859,916 | 1/1975 | Zimmer | 68/202 X |
| 4,046,506 | 9/1977 | Feess et al. | 8/500 |
| 4,057,864 | 11/1977 | Wild | 8/500 |
| 4,099,393 | 7/1978 | Norris et al. | 68/202 X |
| 4,193,762 | 3/1980 | Namboodri | 8/500 |
| 4,658,753 | 4/1987 | Eklund . | |
| 4,892,057 | 1/1990 | Zimmer | 118/249 X |
| 4,917,040 | 4/1990 | Suzuki | 118/249 |
| 4,963,400 | 10/1990 | Bibbee et al. | 118/249 |

FOREIGN PATENT DOCUMENTS

| | | | |
|---|---|---|---|
| 310547 | 7/1970 | Austria . | |
| 1460217 | 12/1968 | Fed. Rep. of Germany | 68/202 |
| 1804785 | 9/1973 | Fed. Rep. of Germany . | |
| 360485 | 1/1981 | Fed. Rep. of Germany . | |
| 3618935 | 12/1986 | Fed. Rep. of Germany . | |
| 3713278 | 11/1987 | Fed. Rep. of Germany . | |
| 2294764 | 7/1976 | France . | |
| 1463090 | 2/1977 | United Kingdom . | |

*Primary Examiner*—Frankie L. Stinson
*Attorney, Agent, or Firm*—Herbert Dubno

[57] ABSTRACT

A process for applying and/or impressing or removing of aqueous liquids on or from a surface or a thereon guided weblike by means of a roller pressed against this surface or web includes pressing the working roller having over its entire working width an absorbing surface against the surface and subsequently relaxing it again, and varying the contact pressure force or the compression of the surface for controlling the amount of liquid to be transferred.

9 Claims, 8 Drawing Sheets

PROCESS FOR APPLYING, IMPRESSING OR REMOVING LIQUIDS OR SUBSTANCES

CROSS REFERENCE TO RELATED APPLICATIONS

This application is a national phase of PCT/AT91/00094 filed Aug. 14, 1991 and based, in turn, upon Austrian National Application A1702/90 filed Aug. 6, 1990.

FIELD OF THE INVENTION

This invention relates to a process and a device for applying impressing or removing aqueous substances, or free flowing substances on a web like material, particularly textile material by means of a roller pressed against this surface or web.

BACKGROUND OF THE INVENTION

In simple cases, a liquid or flowable substance to be controlled on, a web can be water, e.g. when a web of material, a flat formation, a roller or the like is to be humidified or dehumidified. The liquid can also contain various chemicals, for example dyes, impregnating substances and/or solid substances. It can also be a foam.

It is known to apply substances by means of magnetically pressed rollers It is also known to use rollers pressed by magnetic force, which are either dipped into a liquid or are supplied by a feeding roller. In both cases, on the surface of the application roller a thin film of liquid is created, which is then transferred by the application roller at the contact point. In the wedge formed in front of the contact point an accumulation of liquid can result.

In application roller with a smaller diameter applies less substance and the amount of applied substance increases with the diameter of the roller. A weaker or stronger pressing force applied to the rollers results, for instance, in a textile surface with different depth effects, but the amount of applied substance is basically determined by the diameter of the application roller.

The surface structure of an application roller also influences the amount of applied substance. As a rule, application rollers with structured, rough or engraved surfaces, or with wire wrappings apply more substance than rollers with smooth surfaces. The nature of the substance to be applied, its adhesion to the roller and the absorption capability of the substrate also have influence on this type of amount determination.

OBJECTS OF THE INVENTION

Still another object is to provide an apparatus for implementing the process according to the invention.

Yet another object of this invention is to carry out the process according to the Invention with the highest possible degree of uniformity, by taking into consideration the depth action desired in each case and at the same time insuring a gentle treatment of the material.

SUMMARY OF THE INVENTION

The process of the invention offers great variety in its application possibilities and achieving a precise setting, implicitly and a precise reproducibility of all technologically important parameters. There is independence from the tension of the web and it is possible to achieve electrically actuated, precise, electrically controllable setting, and if desired even automatic setting of the pressure force and pressure uniformity over a working width as large as desired. Easy handling, reliable operational safety and a high degree of economic efficiency as a result of relatively low manufacturing and operating costs are to be mentioned as specific advantages.

A cylinder, or roller, which is attracted or pressed by preferably magnetic force applied directly or indirectly to this roller achieves a strong capability of influencing the application output, or conversely the stripping output, or the substance absorption capability.

The device of the invention is characterized in that the working roller has over its entire working width a surface capable to absorb, store, transport liquid and to deliver it under pressure and that either the working roller or the counter surface is covered over the entire working width by an absorbent and/or compressible jacket and that in the presence of a liquid or flowable substance on or in the roller jacket (8) or on the surface, or in the web of material, the liquid applying or liquid removing transfer process with substance amount control is a result of the fact that the jacket covering the working roller or the counter surface is compressed and following this compression again released at least once per rotation in its operational state during the rotation of the working roller, i.e. at each surface line of its circumference, due to a pressure pushing the working roller against the surface exerted in one of the areas (in a zone) of the jacket (8), and that the pressure can always be varied, by the single or multiple volume-altering compression of the jacket caused by the contact pressure determining the amount of transferred liquid.

All characteristics of a working roller with a jacket and can be equally applied to incompressible countersurfaces. In the case of a voluminous, compressible material web, the jacket layer can be correspondingly reduced or even dispensed with.

The process step causing either a substance absorption or a substance can be for instance, carried out by means of tangentially touching or pressed surface, which can be an elastically bendable plate.

Instead of a surface or plate as described above, it is also possible to provide a roller. Such a roller can also be a driving roller or a magnetic roller.

The pressing of the working roller against the material web, on which the application can take place or from which the liquid or wetness are stripped, is performed by means of magnetic force attracting the working roller. When the counter roller, or countersurface is pressed against the working roller it is designed as a magnetic roller, a magnetic table, or magnetic beam with flat or rounded gliding surface.

The working roller can also be pressed against a second adjacent jacket area. However this is to be done in addition to the aforedescribed pressure. generated by magnetic force.

This optional, additional pressure can be produced either by a roller or by a beam which rests against the working roller in the second jacket contact zone with for instance a rounded gliding surface.

The beams having a design similar to a slide bearing can be pressed for instance by mechanical, hydraulic or pneumatic forces.

The aforedescribed pressure against a second contact surface of the working roller can also be produced by magnetic force.

Such a pressure beam designed like a slide bearing can also be pressed by leverage, whereby the force acting upon the leverage can be for instance of hydraulic, pneumatic or magnetic nature. It is also possible to apply the pressure force acting upon the pressure beam to several pressure zones distributed over its length or working width.

In order to improve the dye penetration, the one of the two magnetic rollers against which the material web is pressed can be provided with a compressible layer with liquid-storing characteristics, identical or similar to the one provided on the working roller.

The jacket surface can have an additional uniformization effect as a result of its compressibility and its liquid-storing characteristics.

However, it is also possible to supply this roller or this additional outer layer of the roller with a second additional amount of liquid. For this purpose a second substance-feeding device can be a device wherein the contact pressure required for the transfer process is produced by magnetic force.

The invention offers the extraordinary variety of application possibilities, such as metered application of a liquid or a paste on a textile web or on a paper web, dewatering squeezing of a previously dipped textile web, additional wetting of a wet textile web or wetting of a textile or paper web.

According to this invention the actual working element, i.e. the working roller, is provided with an absorbent and compressible jacket and this roller performs not only one operation but several operations simultaneously, for which purpose the elements surrounding or touching the roller are also involved.

According to the invention, the same roller can receive in one of its jacket zones, evenly distributed over the entire respective application width, a substance amount which can be determined and controlled according to the invention, and then deliver this amount of substance at a different point, whereby both jacket zones determine the amount to be applied due to the interaction of the selective and variable adjustability of the pressure force, namely both in mutual interdependence. Reciprocally, the same is possible during the removal of liquid from a wet or humid web of material.

Functionally speaking the metered substance absorption on the working roller or in its jacket can cooperate with the metered substance transferred onto the material web. By the same token, with the same device of the invention running this time in the opposite direction of rotation or web travel it is possible to remove a portion of liquid from a relatively wet web of material, whereby again both pressure processes cooperate functionally and in mutual interdependence. Besides, it is also possible in a simplified application of the device of the invention to dewater an excessively wetted web of material running through a bath, whereby in this case the working roller performs two functions:

First, the squeezing function of a pressure roller known to the state of the art.

Second, at the end of the pressure application zone, and additional removal of wetness due to the fact that during pressure decrease when the volume-reducing densification of the jacket capable of suction is also relaxed, an additional amount of liquid is removed from the material web and transferred to the material of the jacket surrounding the working roller. This dehumidification bonus results in energy and cost savings when compared to the known state of the art.

All these functions are carried out over the work width, with a uniformity which can be controlled by zones due to the invention. A further economic advantage results due to the invention from the easy exchangeability of the working rollers or optionally only of the working-roller jacket.

The device according to the invention can be directly triggered by an automatic device measuring surface weight and humidity and emitting control signals. The response can occur over the full width as well as by zones without restricting and pressure continuity, i.e. seen over the entire width, as it is the case with roller pairs with zoned pressure in the state of the art.

The pressure force can be generated by a magnetic field or by any mechanically, hydraulically, or pneumatically etc. actuated mechanisms, whereby devices according to the invention are provided for the magnetically as well as mechanically generated pressure force.

In a further embodiment examples representing the main concept of the invention a combination is presented. A working roller surrounded by an absorbent and compressible material transporting liquid at its surface is supported in an open slide bearing beam, which can be made in one piece or in several places, and is pressed by this beam against the counter roller. The counter roller can be, for instance, a magnetic roller. A combined or a selective use of the pressure force is possible in this embodiment.

Still a further embodiment of the invention is the one wherein two such magnetic rollers act together but with oppositely directed forces upon the same working roller. It is also possible to subject the working roller to the action of a magnetic field generated outside a roller.

In the embodiments of the invention a slide bearing beam pressing the working roller, can be subdivided into pressure zones and can, as a secondary function, replace the second counterpressure roller.

The slide bearing beam can be pressed against the working roller or can cooperate with the working roller against the counter roller by a pneumatically or hydraulically actuatable mechanism and is optionally subdivided into zones. Also, according to a feature of the invention, the pressure force can be provided by leverage, whereby in a further development of the invention's main concept the force acting upon the longer, freely designed lever arm can be produced by a magnetic field.

The application of such a magnetic force in order to produce the pressure of a circumferentially supported cylinder or roller without axle bearing over a slide bearing beam is of essential importance. From the economic point of view, it is advantageous due to the possible saving of high expenses for not only one but even two magnet rollers to be used. From the technical point of view because the electromagnetically effected pressure works through a lever system, whereby this magnetically effected pressure force can be multiplied, and because the electromagnetically effected pressure force can be applied directly in zonewise distribution, becoming effective electrically, i.e. triggered instantly, which could not be achieved with the same quick and precise efficiency in the heretofore-known zonal pressure control systems due to the transmission via, for instance, a hydraulic system inside the roller and to roller deformation.

According to an embodiment of the invention, the slide bearing beam known to the art and made of rigid and unyielding material and subdivided in zones over the work width, can be replaced by a slide bearing beam made of a resilient, moldable material in one of several segments. Therefore the slide bearing beam can optimally adjust to the working roller.

The concept of the invention to use as a pressure element a cylinder or roller without axle bearing and having a relatively small diameter supported on at least one jacket zone and designed for transport of liquids and to press it fittingly against an axially supported roller of larger diameter with a corresponding slide bearing beam made of a relatively easily bendable material is taught by the invention.

The invention characterized by several inventive concepts differing from each other can be applied in practice through various embodiments, whereby all these possible, different embodiments can be realized through surprisingly simple constructions.

The following can be said about the already described extent of the invention:

In a device built according to the invention, substance-supplying and substance-removing configurations can be integrated;

the working roller can additionally be axially driven, this with the same peripheral speed or also with friction with respect to the counter roller or to both counter rollers, in case two of them are provided and both are driven;

it is also possible to provide an axial drive only for the working roller, thereby having the counter roller or optionally the two counter rollers driven by peripheral, respectively lateral-surface pressure.

A preferred embodiment is the one wherein the counter roller is axially driven and thereby drives the working roller through lateral-surface pressure over its circumference. If a second counter roller is available, it can be driven peripherally by the working roller. The produced friction can, favor the efficiency, further lowering the production cost since only a single application of driving force is required in order to drive two even three rollers. However, it is also possible to apply the driving and optionally also the pressure force also over a third peripheral zone, whereby the three peripheral contact zones are arranged with a preferred distribution of approximately 120° on the working roller.

When two counter rollers are used, there are various arrangement possibilities for the web guidance. For example, it is possible to pass the goods either through one or two pressure zones. Still it is also possible to dip the web of material into a pass before the so-called roller wedge in front of the first pressure zone, which can be one-sided or two-sided.

For the working roller is pressed by the slide bearing beam and by magnetically generated lever force (FIG. 10) a further embodiment of the invention is provided. In order to adjust the magnetic device to various thicknesses of the material web and in order to make possible the application of additional, also mechanical modification of the pressure force, the device producing the magnetic field is equipped with an adjustment or displacement mechanism for position changes in relation to the free, magnetizable part of the lever arms assigned to the magnetic field.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
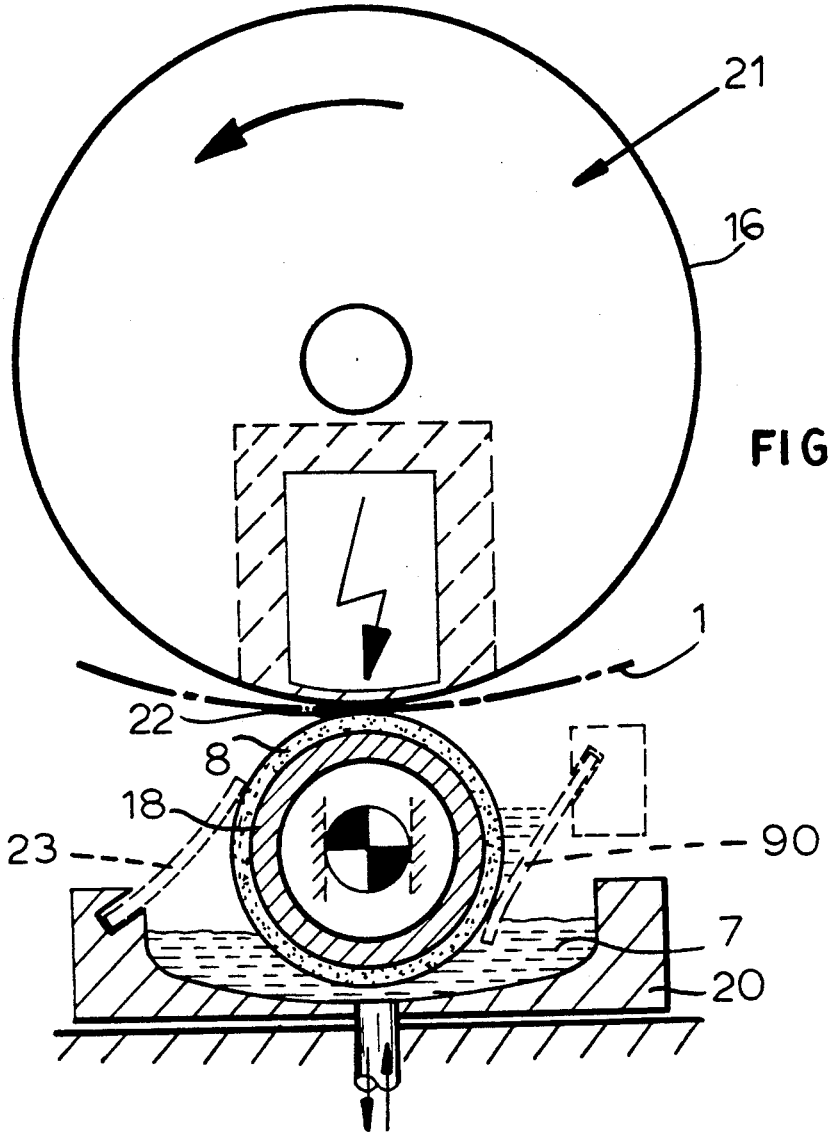
FIG. 1 shows an embodiment according to the present invention.

FIG. 1 shows a working cylinder roller 18 consisting of a magnetizable, tubular or massive cylindrical roller body, mounted so that its axis is movable at least in one direction, which is surrounded by a compressible roller jacket 8 made of an absorbent material and which is attracted to or pressed against a surface or roller by magnetic force.

In this embodiment (FIG. 1) this surface is the outer shell of a hollow cylinder 16, inside of which a magnetic field is present. In this embodiment which illustrates the device during operation, the compressible, absorbent roller jacket 8 is densified (compressed) in the contact area with the hollow cylinder 16.

The working roller 18 dips with the lower part of its cross section or of the absorbent, compressible roller jacket 8 into the substance 7 to be applied which is thereby taken up by the absorbent roller jacket 8, it is brought to rest against the hollow cylinder 16 due to the rotation or peripheral motion of the latter and due to the action of its inner magnetic field (shortly magnet roller) and is then set to rotate in the same direction due to frictional force-locking.

Depending on the force of the magnetic field, a part of the substance 7 taken up during dipping by the absorbent, compressible roller jacket 8 is squeezed out and flows back into the trough 20.

If a flat formation, e.g. a material web 1 or a piece of goods of any material is allowed to enter the wedge 22 between the magnet roller 21 and the working roller 18, then first the surface is fully wetted with the application liquid, respectively flowable substance 7; second, as far as the web 1 of material or this piece of goods consist of an absorbent material, a portion of the substance 7 to be applied which is inside the absorbent roller jacket 8 is pressed into the web of material 1, or the piece goods. In addition to the thickness and suction capability of the jacket roller 8 and the thickness and absorption capability of material of which the web 1 is made, the most important parameter for determining the respectively desired amount of substance to be applied is the magnitude of the magnetic force generated by the magnetic field respectively the contact pressure of the working roller 18 against the magnetic roller 21, generated by the magnetic force.

Analogously, the aforedescribed device can also be used for any metered removal of liquid from a surface or web of material.

The device according to the invention shown here is surprisingly simple in its construction and operation.

A further possible development of the concept of the invention consists in the fact that the device creating the magnetic field is subdivided into several selectively and mutually independently adjustable or parallelly controllable magnetic field units creating thereby the possibility for automatic control.

Due to this additional, broader construction it becomes possible to achieve the required uniformity of the application or removal operation even on webs or pieces of material having an uneven structure over their width or length, e.g. uneven thickness or density.

A further advantageous possibility is to provide the application cylinder or roller with an additional axial drive. This is particularly advantageous when the device of the invention is set to operate with a relatively weak magnetic field and when the application process has to be carried out with a homogenizing wiping of the applied substance, e.g. on a relatively smooth, nonabsorbent surface. Due to the fact that a driving impulse, decelerated or accelerated with respect to the speed of the web of material, is axially introduced in the application roller, a modification of of the amount to be applied can be achieved, while all the other adjustment parameters remain the same.

If only a very small amount of substance 7 is to be applied, only a relatively weak magnetic field setting is required, as well as a correspondingly weak pressure force acting upon magnet roller 21, or upon the material web 1 pressing thereagainst.

In order to prevent in this case an uneven application, an elastic plate 23 can be provided which extends over the entire application width, respectively roller length tangentially and is pressed against it by being magnetically prestressed, this plate being, for instance, mounted on the trough wall, preventing the entrainment of an amount of substance which would have a negative influence on the application process.

Downstream of the application zone, a second elastic plate 90 can be prestressed to press against the working roller 18, serving as a countersurface. When such a plate 90 is provided, the substance feeding can take place in the wedge between plate 90 and working roller 18, whereby under certain circumstances the use of a trough can be eliminated.

This step can be modified in a further embodiment of the invention, so that the prestressing force of the springy pressure is increased, thereby slightly compressing outer area of the roller jacket 8 or the outermost layer of the absorbent material of the roller jacket 8 of roller 18, which is the most important for the application of only a small amount of substance and due to that a portion of the substance 7 located in the outer area of the roller jacket 8 is taken up by the doctor blade.

This step has proven to be just as advantageous for removing of substance or liquid off or from the material web 1 as for applying the former on. The aforedescribed additional device or step cannot be compared to any of the numerous types of stripping blades known to the state of the art. The blades known to the state of the art are characterized in that the outer edge of the blade is pressed against the surface to be stripped either for the purpose of cleaning a roller or for wiping off an engraved roller surface.

By contrast with the known devices, a stripping based on the compressibility of an absorbent roller jacket made for instance of absorbent textile material with a plate tangentially resting thereagainst is characterized by the absence of contact in the outermost border and edge areas and the aforementioned compression of the absorbent jacket can be performed without damaging the outer jacket layer by abrasive contact.

Figure 2:
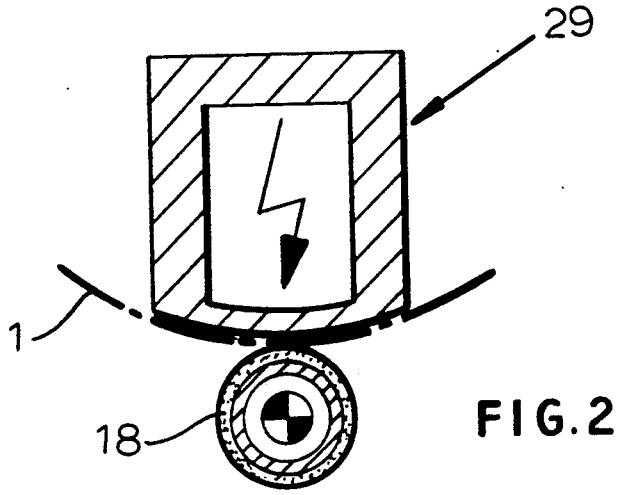
FIG. 2 is another embodiment showing a working surface connected with a magnetic device.

FIG. 2 shows that instead of the working surface on the hollow roller with the therein arranged magnetic device, as shown in FIG. 1, a working surface connected with a magnetic device can be used, such as for instance a magnet beam 29. However, this simplified device requires a stable, nonstretchable web of material 1 or a driven working roller 18.

Figure 3:
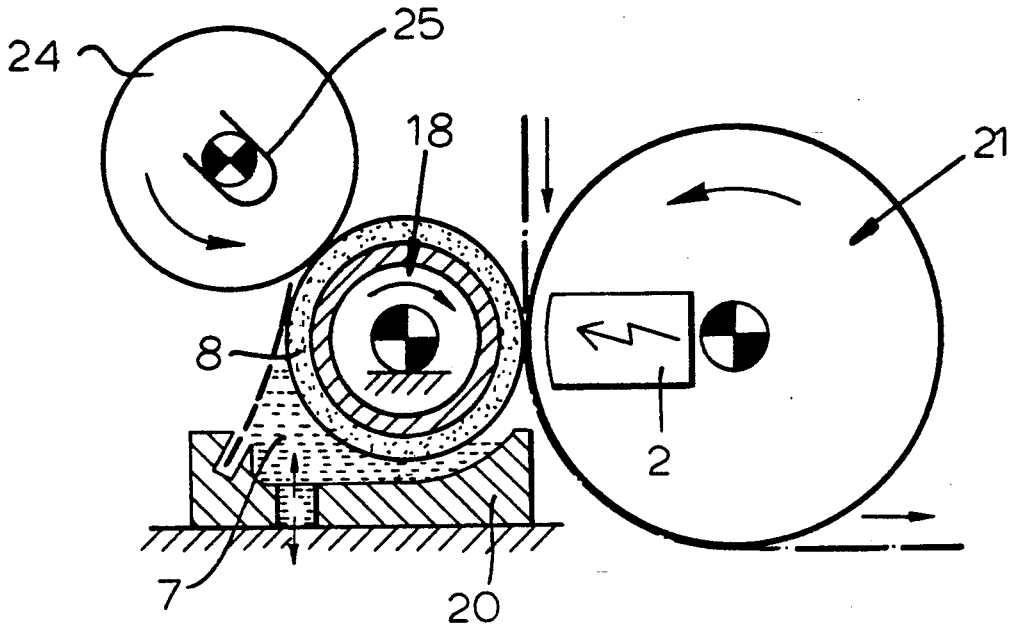
FIG. 3 is still another embodiment showing an axially pivotal roller guided in a guide for annular movement toward and away from the working roll.

FIG. 3 shows on a smaller scale than FIGS. 1 and 2 a further inventive development of the device shown in FIG. 1. Instead of the tangentially touching prestressed elastic plate 23 of FIG. 1, in FIG. 3 a touching roller 24 is provided approximately at the same point, supported by means of axle pivots in an inclined guide 25 and which presses against the working roller 18 due to its own weight.

In an advantageous embodiment, this roller 24 retaining the substance 7 in the trough 20 and slightly compressing the absorbent roller jacket 8 of the working roller 18 against which it rests, can be a permanent magnet or can be equipped with permanent magnets, which causes an increase in the pressure and thereby an increase in the amount of substance 7 removed from the jacket, thereby reducing the targeted application amount.

In a further advantageous embodiment the roller 24 can also be a magnet roller. Following the rotation, at first only the superficially adhering entrained substance 7 and than also a part of the substance stored in the absorbent jacket is removed from the working roller 18 by the magnet roller and returned to the trough.

This double-acting measure corresponds in the process of the invention to the so-called predosage, i.e. a preparatory step for the amount control the adjustment of the dosage of the substance-transferring working roller to the magnet roller.

This predosing operational step is followed in the direction of rotation at the magnet roller 21 (magnetically actuated pressure zone) by the transfer of the controlling determination of the application amount for the application process of the invention whereby this determination of the amount to be applied is also controlled through the contact pressure and whereby the amount control possibilities regarding the possible upper limits of the application amounts depend, or are predetermined by the substance amount in the absorbent area of the roller jacket 8 of the work roller 18 established during the predosing step.

When all its possibilities are fully developed, the working process according to the invention is characterized by two functions performed in its direction of rotation and succeeding each other spatially, namely a main function and an auxiliary function. Each one of these functions can be controlled separately and optionally subdivided in pressure zones over the width, i.e. as required either individually or in common (intensity-dependent). The pressure force can be effected electromagnetically in an advantageous development of the invention concept and therefore can be controlled in its intensity electrically, i.e. becoming instantly effective, which is also possible in automated process control techniques.

Preferably with the roller 24 so much substance or liquid 7 is removed for the purpose of predosing, dosing or stripping, that no wedge of liquid is formed at the application location. A further process technique according to the invention consist in that the aforedescribed device of the invention can be used depending on need for the application of liquids, respectively flowable substances on a flat formation, which can be for instance a web of material or a transfer roller, as well as a device having the following opposite characteristic function.

The device of the invention is fed with a wet or damp web 1 (web of material, transport belt), from which, due to the pressure of the working roller according to the invention, liquid or flowable substance 7 is taken up and transferred to the jacket of the working roller 18. By continuing its rotation, the working roller 18 reaches a second pressure zone, against the roller 24 or magnet roller and as a result of a relatively bigger pressure force and a therefrom resulting stronger compression of the roller jacket 8, the previously taken up liquid or flowable substance 7 is removed again and returned for instance to the trough 20 which is equipped with an outlet opening.

Figure 4:
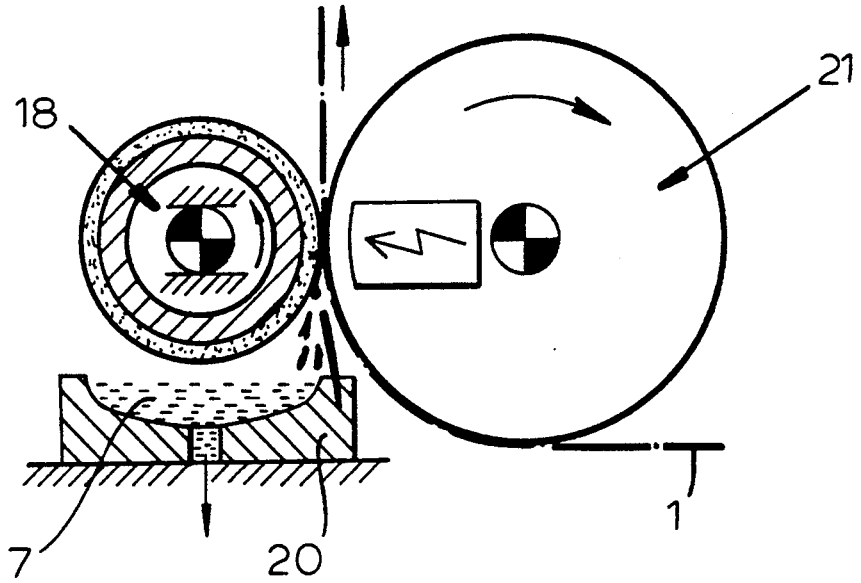
FIG. 4 is yet another embodiment for stripping of liquid off a web of material.

FIG. 4 shows an embodiment similar to the one shown in FIG. 1, which is particularly suited for the stripping or removal of liquid or substance 7 off the material web 1. The axes of the working roller 18 and the magnet roller 21 lie thereby in a horizontal plane with the contact point of the two rollers 18 and 21, the working roller is movable in the direction of the connection between the two axes. Due to this arrangement, the substance which has been squeezed from the material web 1 can drip into the trough 20 located therebelow.

Figure 5:
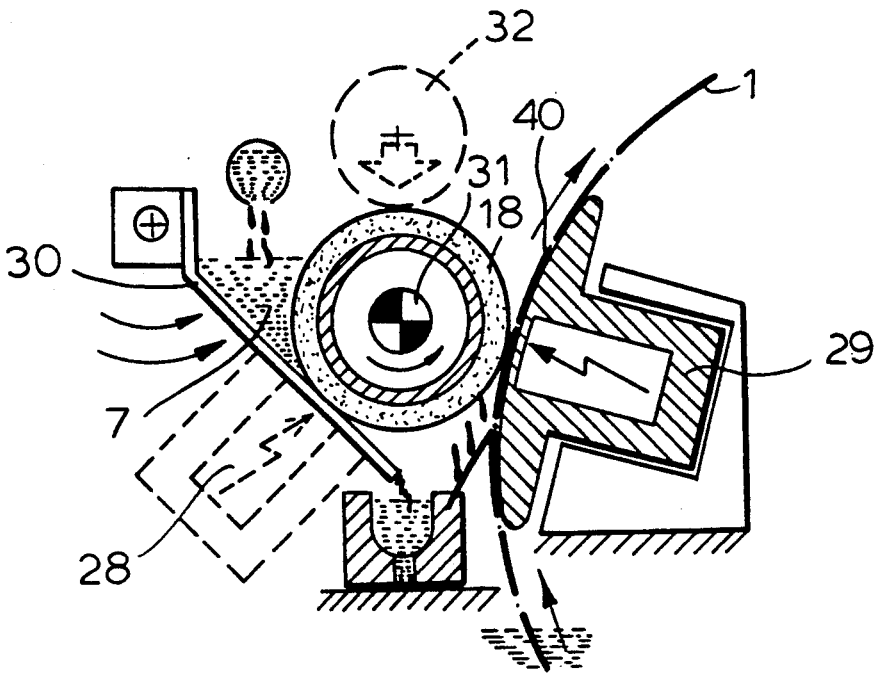
FIG. 5 is a further embodiment showing two magnet beams acting as substance-carrying and predosing device.

FIG. 5 shows an application device according to the invention which is built so that instead of the so-called magnet rollers, magnet beams 28, 29 are used, one of which—28—performs the substance-carrying and predosing function is designed with a flat slide surface 30. This surface together with the working roller 18 form a trough for the substance 7 to be applied. A second magnet beam 29 effecting the application process with, for instance, a rounded application surface 40, which carries out the application process on the web of material 1.

A precondition for this process is the stretch stability of the web 1 which can be moved with a sufficiently high traction in order to overcome the friction forces. If the stretch stability or the traction, is not sufficient or the surface of the web is too smooth in order to set the working roller 18 into rotation by pressing it against the material web 1 and this rotation can be triggered by a drive 31 either axially in the working roller 18 or peripherally by means of an additionally driven tension roller 32 contacting the working roller in a third peripheral contact zone.

Instead of arranging magnets in both beams, it is also possible to provide only one, approximately in the bisecting line between the slide surface 30 and the tangential surface to the adjoining surface 40, or to replace the magnetic beam 28 by another force-generating source. In this arrangement, the magnetic beam 29 can serve also for the removal of substance 7 from the material web 1 dipped in a bath.

Figure 6:
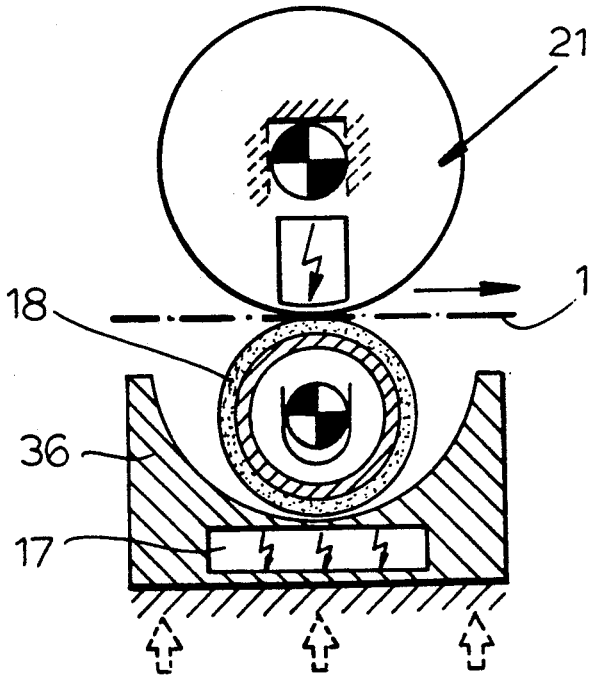
FIG. 6 is an embodiment of the invention showing a slide-bearing beam exerting pressure on a working roller.

FIG. 6 shows a further embodiment of the device of the invention. The spatial arrangement corresponds to the arrangement shown in FIG. 1. Instead of the trough, a slide-bearing like pressure beam 36 is provided, which, in the inclined position like the one shown in FIG. 5 can be a magnetic beam, i.e. equipped with a device 17 producing a magnetic field, but also can exert hydraulic or pneumatic pressure on the working roller 18.

The concavely curved surface pressed against the working roller 18 in the manner of a slide bearing takes over the same function performed in FIG. 1 by the elastic plate 23, or in FIG. 5 by the inclined sliding surface 30, or in FIG. 3 by the shown roller 24, and in addition thereto it also performs the pressurizing of the counter roller 21 or of the material web 1 guided over this roller.

If a sufficiently strong friction force lock exists between the working roller 18 and the counter roller 21 or the web of material 1, it is enough to apply only one pressure force in order to produce both pressure actions required by the process, as long as this pressure force is externally induced in one of the two rollers or in the slide-bearing like beam or vice versa in the roller transporting the material. Thereby, either the beam can be movable and the roller 21 can be stationary or the roller is movable relative to the beam. If the pressure beam 36 is stationary and the roller 21 is movable, gravity can also be used as pressure force.

Figure 7:
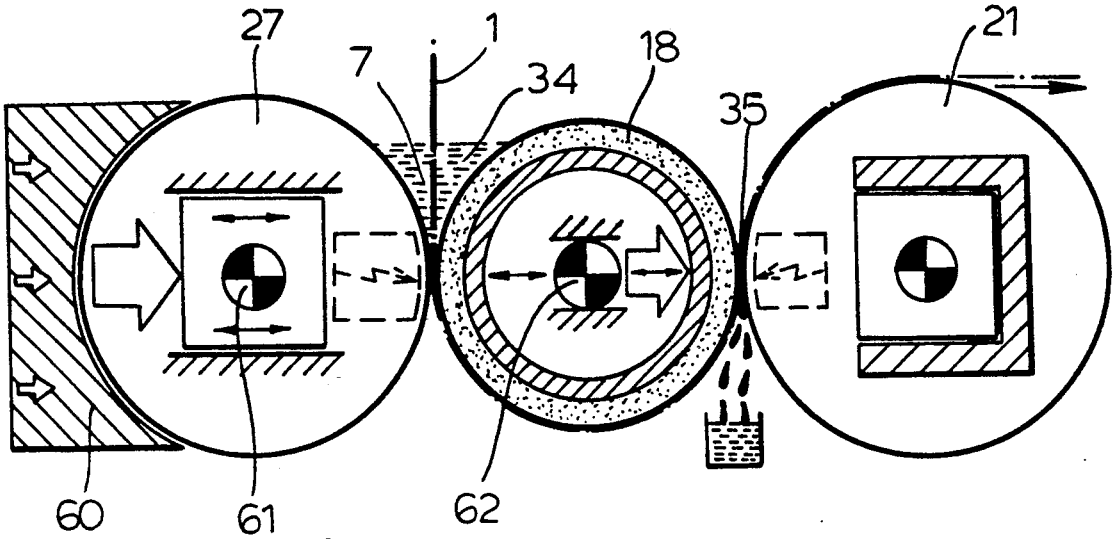
FIG. 7 is an embodiment according to the invention showing a working roller arranged in one plane with two pressure rollers forming thereby two wedges filled with a substance.

FIG. 7 shows a device according to the invention having a construction similar to the one shown in FIG. 3, with the difference that the axes of both rollers 21, 27 and of the working roller 18 are arranged in one plane, whereby on each of the two sides of working roller 18 so-called roller wedges 34, 35 are created. In FIG. 7, one of these two wedges 34 is filled with substance 7. The baffle plates (not shown in the drawing) arranged laterally at the frontal sides of the roller, or selectively in the wedge area, prevent the application liquid or substance from running off at the sides.

Three different working functions are possible. Two are as already described in FIG. 3, a third is that a downwardly guided web of material will run first through the wedge with the application liquid or substance 7, immediately thereafter through the first pressure zone and then the second pressure zone. This arrangement creates the possibility of further homogenization and full penetration of for instance a voluminous web of material.

As shown herein, it is possible to use the working roller 18 also as guide roller for the material or the material web 1 can be guided over an additionally provided guide roller (not shown in the drawing).

The roller 27 and the working roller 18 are slidably movable in the illustrated variant, while the roller 21 is fixed. The pressure can be exerted over the slide bearing beam 60, e.g. pneumatically, or over the axle pivots 61, 62, e.g. hydraulically. However it is preferable to use magnetic pressure, for which purpose the rollers 21, 27 are designed as magnet rollers and the working roller 18 is made at least partially of magnetizable material. The use of magnet rollers improves the process technique and saves on mechanical pressure means and stationary rollers.

Figure 8:
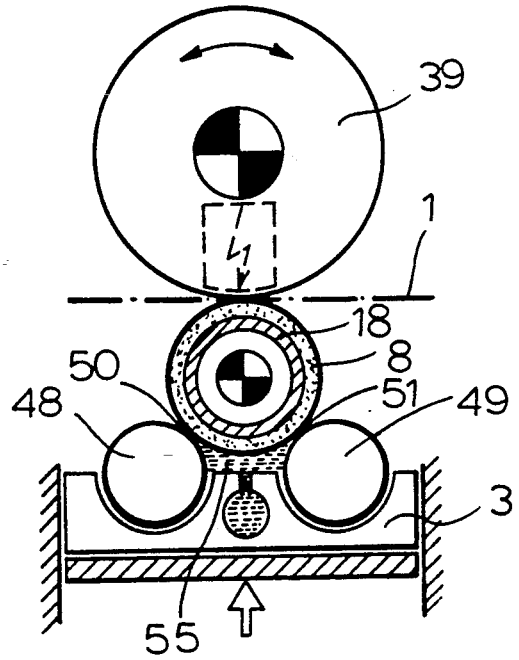
FIG. 8 is another embodiment showing two application rollers forming a substance basin therebetween receiving a working roller.

FIG. 8 shows a construction according to the invention which starts out from the embodiment shown in FIG. 6. The slide bearing body is not shaped like in FIG. 6 with a widely open slide bearing surface, but with two snugly fitting slide bearing surfaces. Two force-transmitting rollers 48, 49 are provided in these two, relatively closely surrounding slide bearing surfaces, these rollers transmitting the pressure force P induced in the slide bearing body 3 to the working roller 18 in the contact zones 50 and 51.

In this device it is possible to cover the working roller 18 with a layer 8 which has only minimal sliding characteristics, respectively little abrasion resistance, respectively is compressible and for one of these reasons or for another reason should not be supported directly slidable in the slide-bearing pressure beam 36.

The hollow space 55 is filled with a liquid to be applied and the working roller 18 is surrounded by the compressible liquid receiving jacket 8, and the liquid taken up by this jacket in the area of the liquid-storing space 55 is again squeezed out in the squeezing gap between working roller 18, or its jacket 8 and the slidingly supported roller 48. Therefore, this portion remains in the space 55. The portion of the liquid intended for the application which remains in the jacket is transferred to the material web 1 in the pressure zone of the working roller 18 against the counter roller 39. In this embodiment, the roller 48 takes over the function of the tangentially adjacent plate 23 shown in FIG. 2 with the advantage of the precisely controlled pressure force of the working roller 18 against the counter roller 39. The roller 39 can—but does not have to—be a magnet roller and also can be replaced by a magnet beam.

Figure 9:
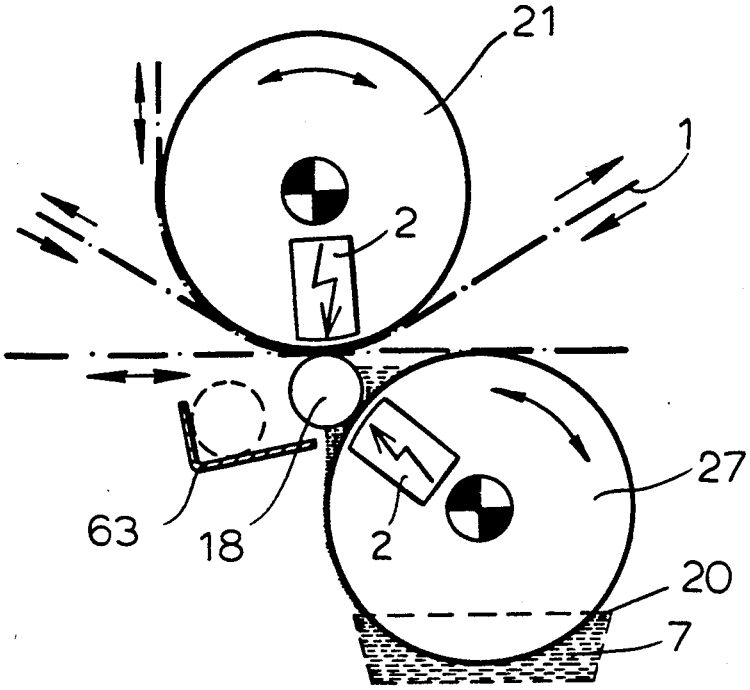
FIG. 9 shows an embodiment having two stationary supported magnet rollers.

FIG. 9 shows an embodiment variant similar to the embodiment in FIG. 3 with two stationarily supported magnet rollers 21, 27, one of which, the magnet roller 27, reaches into a trough 20 filled with substance 7 and doses the substance 7 at the working roller 18 and the other roller 21 arranged obliquely over or next to it, serves as a guide for the material web 1 and as a counter roller in the dosed application of substance 7 by the working roller 18 onto the material web 1. Due to the magnetic attraction exerted of the working roller 18 from two sides by means of magnetic devices 2 located in the magnet rollers 21, 27, no axle pivots are required for positioning or holding the working roller 18. If no magnetic force acts upon the working roller is shown in dash lines, it rolls into a catching device 63.

Figure 10:
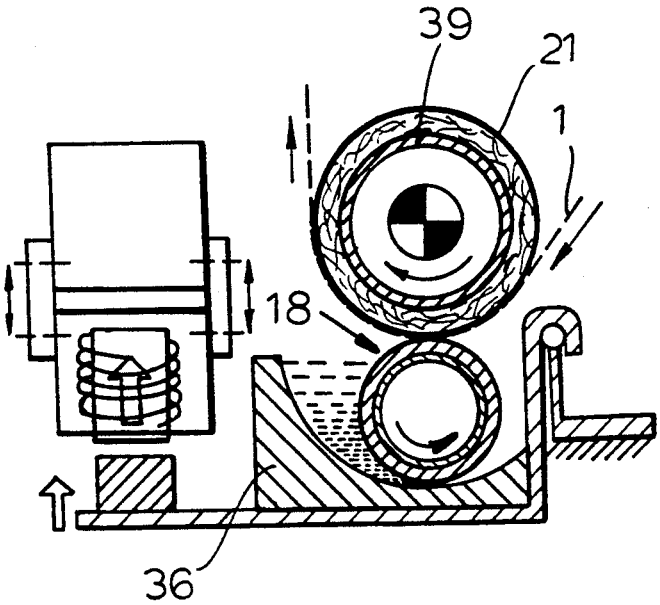
FIG. 10 is an embodiment showing coverage system transmitting a pressure on a working roller.

FIG. 10 develops the construction concept shown in FIG. 6, a further inventive development of this construction consisting of novel application of magnetically produced pressure force. Instead of inducing the pressure force directly at the slide bearing pressure beam 36, this takes place through leverage.

Thereby, the sometimes required high pressure forces can be achieved with little effort using the leverage effect. As a result of the embodiment using the leverage, the magnetic device can be small and cost effective. The use of electromagnetically effected pressure force, when compared to the hydraulically or pneumatically effected pressure forces, offers the important technical and economic advantage of considerably shorter reaction times when triggering technologically required changes in the pressure force. Of course, it is also possible to produce the pressure hydraulically or pneumatically as previously described.

Figure 11:
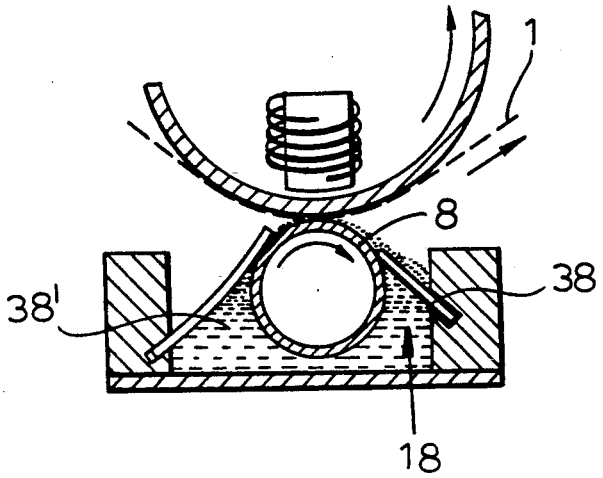
FIG. 11 is an embodiment of the present invention showing a pressing blade urged against a jacket of the working roller.

FIG. 11 shows a further embodiment, which can be illustrated with any of the embodiments shown in FIG. 1. Provided that the outer shell of the compressible jacket 8 of the working roller 18 is smooth and has frictional stability, e.g. a thin perlon tube over a felt layer, a gently pressing stripping blade 38, preferably of plastic material, can be applied to remove the impurities which cling to the web of material 1 and are transmitted to the working roller 18. In this construction characteristic to the invention is both elements 38 and 38' resting against the working roller by spring force are prestressed magnetically.

Figure 12:
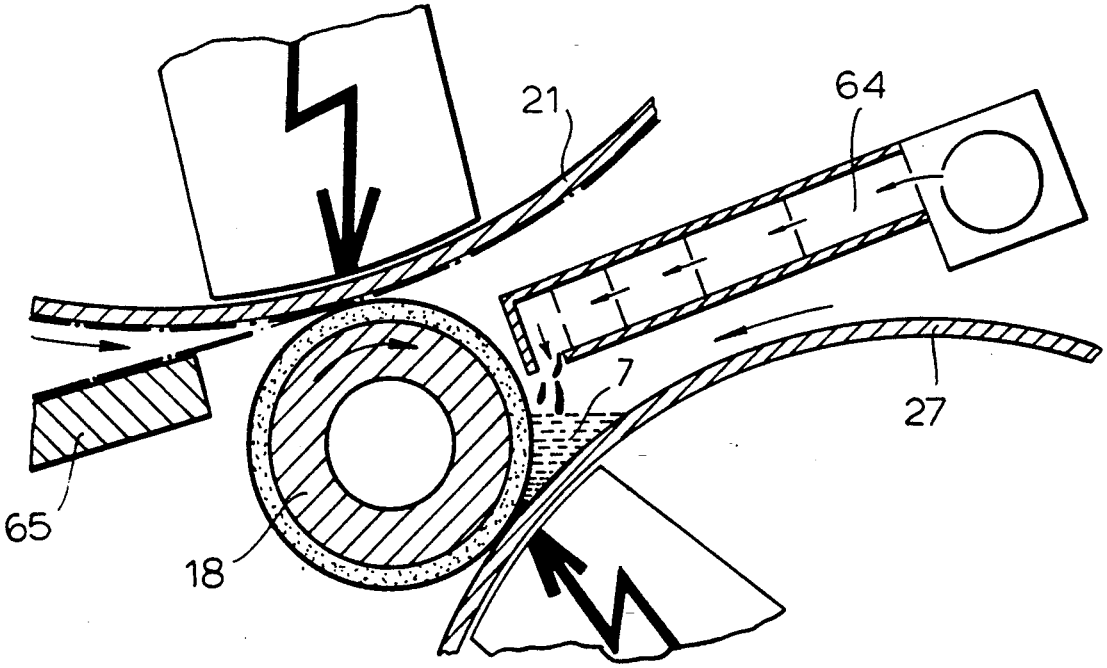
FIG. 12 is an embodiment showing a feeding ledge provided with a means for evenly distributing liquid over a width of the working roller.

FIG. 12 shows a detail of the substance supply similar to FIG. 9. The substance 7 to be applied is fed to the space between the working roller 18 and the predosing magnet roller 27 over a plate-like feeding ledge 64 with a built-in device for even liquid distribution over the width. At the contact point with the other magnet roller 27, which serves as a counter roller and guides the web 1, the substance 7 is transferred to the material web 1 in the manner already described before in detail. In addition, a plate 65 can be provided as an auxiliary device for the introduction of the material web 1 between the magnet roller 21 and the working roller, this plate serving at the same time for protection against accidents.

Figure 13:
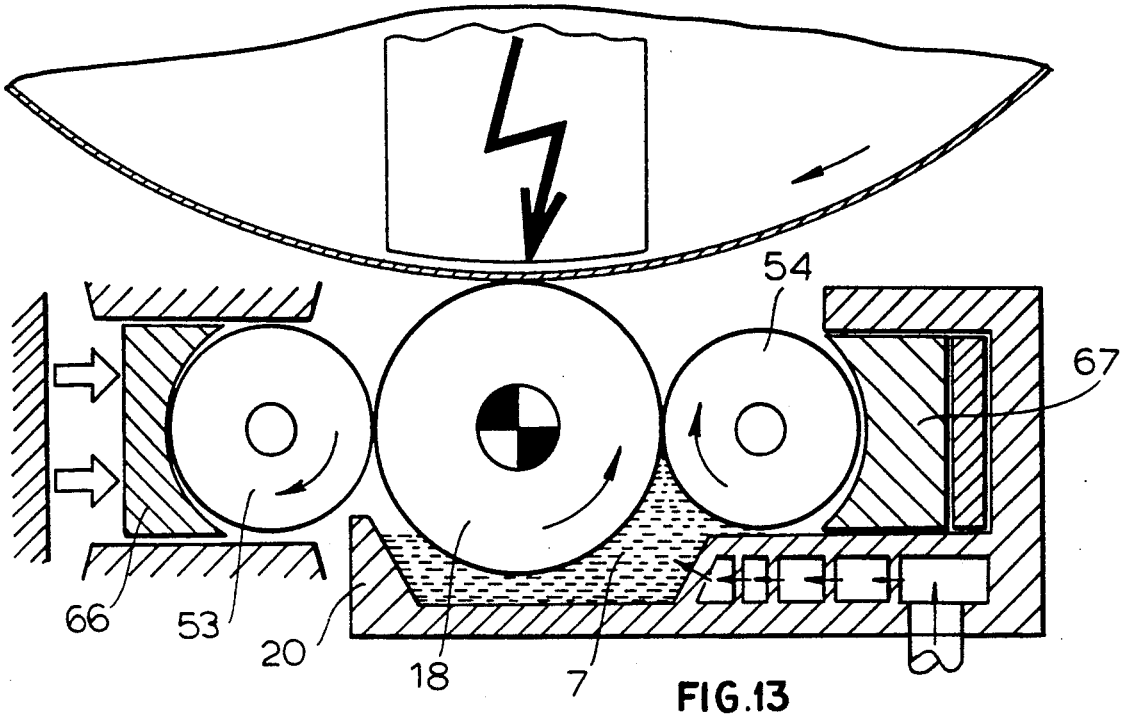
FIG. 13 is an embodiment similar to the one illustrated in FIG. 8 but having working and force transmitting rollers lying in a horizontal plane.

FIG. 13 shows an embodiment variant similar to the one in FIG. 8. The difference is that the axes of the working roller and of the force-transmitting rollers 53, 54 lie in a horizontal plane. Therefore, the rollers 53, 54 have separated, lateral slide bearings 66, 67. The slide bearing 67 of the roller 54 is fixed, e.g. in trough 20, while the slide bearing 66 of roller 53 is horizontally slidable. It is to this displaceable slide bearing that the pressure force determining the substance amount during predosage is applied.

Figure 14:
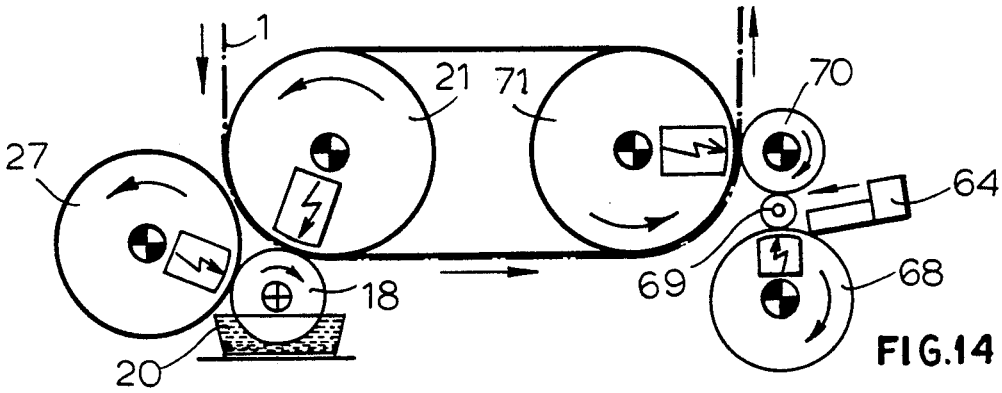
FIG. 14 is an embodiment showing a device according to the invention with two different substances applied successively to the working roller.

FIG. 14 shows a combination of two devices according to the invention, the one of which for instance dehumidifies the material web 1, so that the other can subsequently apply a substance, or wherein two different substances can be successively applied. The device shown at the left is similar to the one in FIG. 3, wherein the roller 24 was replaced by a magnet roller 27 for predosing. Here for instance liquid is stripped or extracted from the material web 1, respectively applied to or introduced in the web. The device shown at the right applies the substance to or presses into the material web 1. Thereby the substance 7 is brought by a plate-like feeding ledge 64 according to FIG. 12 to the predosing rollers 68, 69, wherefrom it is transmitted to the working roller 70, which as described before applies the substance or presses it into the material web 1 guided over the counter roller 71.

Figure 15:
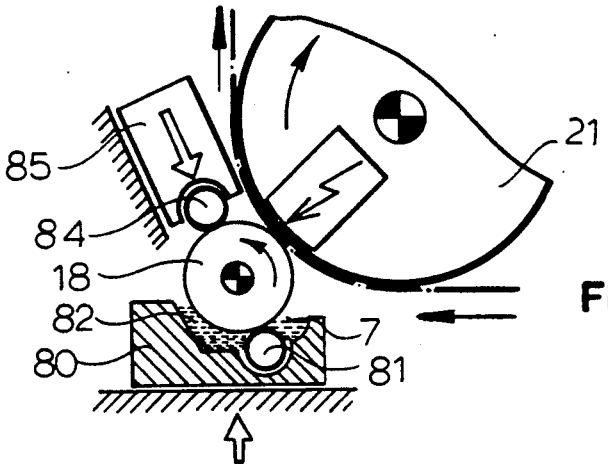
FIG. 15 is an embodiment showing a slide-beam provided with an applying roller which provides practically frictionless application of the substance to the working toller.

FIG. 15 shows a further embodiment variant. In a slide bearing 80, which at the same time serves as a trough for the substance 7 to be applied, lies a roller 81 which allows the thereagainst resting roller 18 to roll off almost frictionless. A linear brush 82 arranged after the contact point with the counter roller 21 guiding the material web 1, in the running direction of working roller 18, ventilates and cleans the working roller 18 and also exerts a counterpressure thereon. The pressing of the working roller 18 against the counter roller can be effected magnetically or by pressure on the movable slide bearing 80. Thereby, a movable slide bearing beam 85 with a roller 84 pressing with its own weight or with pneumatically, hydraulically or magnetically effected pressure prevents the lateral shifting of the working roller 18.

Figure 16:
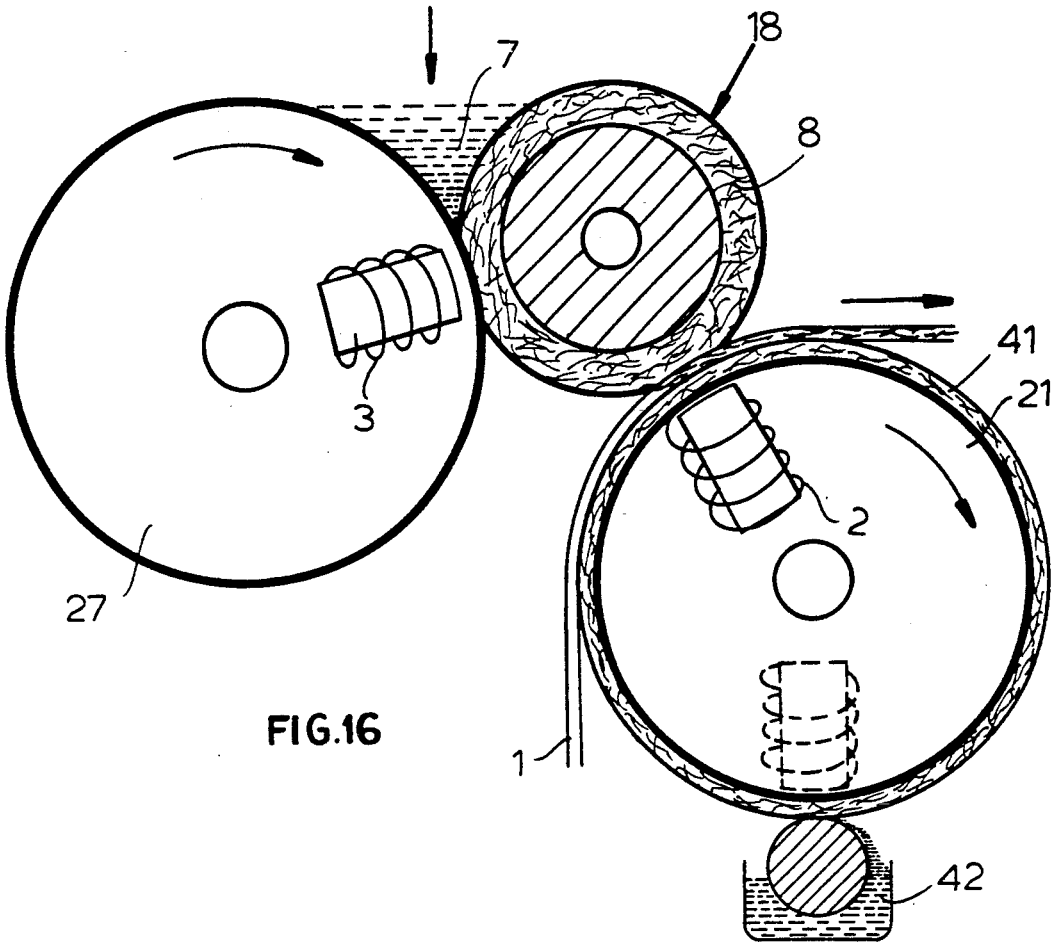
FIG. 16 shows two angularly positioned magnetizable rollers with a working roller therebetween.

In FIG. 16, the transfer of a flowable substance onto a surface can be clearly seen. A web of material 1 is guided over the surface of a roller 21. This roller 21 serves as a support body and the material web 1 wraps around a portion of the roller surface. Parallel to the axis of roller 21 lies the axis of a second roller 27 and between these two rollers 21, 27, a working roller 18 is arranged. This working roller 18 is peripherally supported on the two rollers 21, 27, i.e. upon a rotation of the roller 21 and/or 27, the working roller 18 turns. The working roller 18 is provided with a roller jacket 8, e.g. made of felt, whose thickness is shown here in a highly exaggerated manner. The two roller 21, 27 are hollow rollers and each has inside an electromagnet 2, 3, whose pole surface is directed towards the working roller 18. Optionally, the electromagnets can be swingable. Since the working roller 18 can be either completely made of magnetizable material or can contain such material, due to the creation of a magnetic field, the working roller 18 can be pressed against the surface of roller 21 as well as against the surface of the roller 27. This pressure can be controlled by the strength of the magnet, and in the present case it can be seen that the pressure against the roller 21 is stronger than the one against roller 27. The substance 7 to be applied is pressed at the roller 27 into the roller jacket 8, then transported to the roller 21 where it is again squeezed out. The squeezing can take place onto or into the material web 1, but also onto the surface of roller 21, which can be a transfer roller.

A part of the surface of working roller 18 and a part of the surface of roller 27 define a space for the substance 7 to be applied. By rotating the rollers and the working roller, the substance to be applied is transferred by the working roller 18 to the material web 1 supported on roller 21 and there it is applied to the web. By adjusting the two magnetic fields, the amount of liquid in the jacket of the working roller 18 can be set. The surface of roller 21 and 27 can be a steel surface, optionally made of stainless steel or chromium-plated, but it can also be a surface covered by rubber or fabric.

It can prove to be advantageous during substance application if the magnetic field of roller 27 is weaker than the magnetic field of roller 21, since in this case an optimally effective transfer of the application substance results. During removal of liquid or substance from a web of material, the setting of the magnetic fields should be reversed with respect to the above, and the direction of rotation or the travel direction of the web should also be reversed with respect to the one shown in the drawing. As in FIG. 5, in addition to the peripheral support, the working roller 18 can also be provided with a drive, so that the rotary speed of working roller 18 can be increased or decreased.

The working roller 18 can also be used as a force-transmitting element.

The pressing of working roller 18 against the rollers 21 and 27, respectively against the beams 28 and 29 does not necessarily have to be effected through magnets. The possibility exists to produce this pressure mechanically, pneumatically or hydraulically.

In FIG. 16 a further development of this device according to the invention is illustrated. The magnet roller 21 which is the last to rest against the material web 1 is also equipped with a compressible, liquid-storing jacket 41, which has an additional homogenization effect. As shown, additional substance can be applied through a further substance application device 42, whereby the pressure can also be exerted due to magnetic force.

Figure 17:
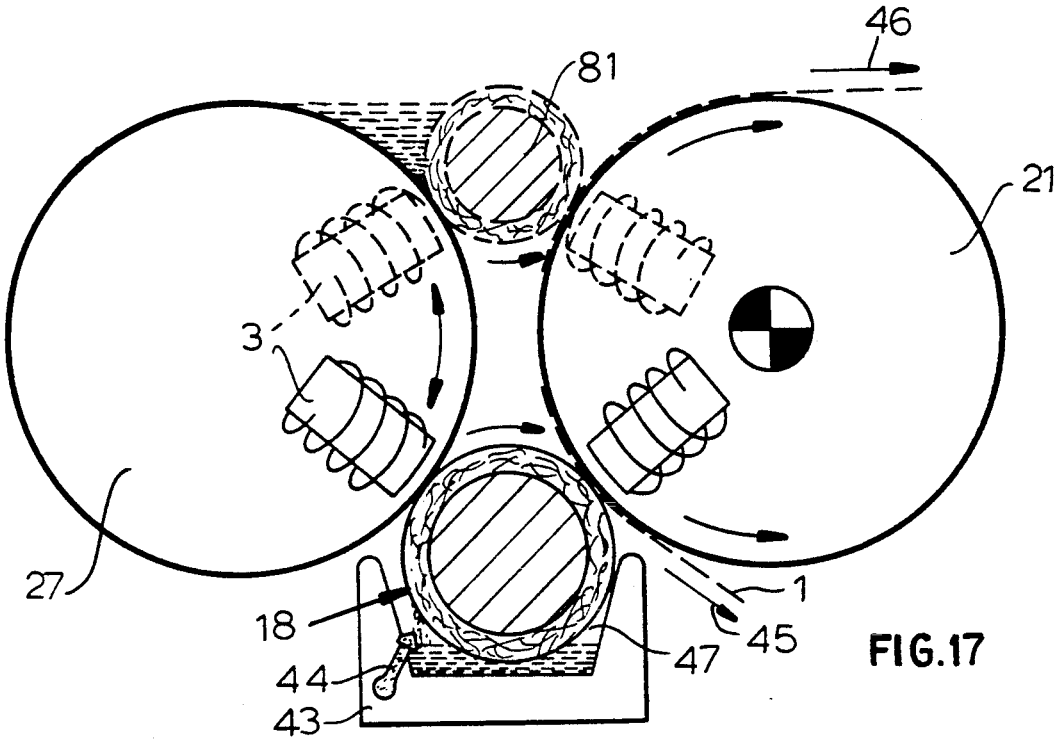
FIG. 17 is the last embodiment of the present invention showing two supporting rollers lying in parallel planes and contacting a working roller magnetically pressed thereagainst.

FIG. 17 shows a device of the invention with two magnet rollers arranged at a distance from each other and whose axes run parallelly in a horizontal plane, whereby the same device makes it possible to perform functions represented and described in FIG. 7 as well as in FIG. 16:

Below the gap existing between the two magnet rollers 21, 27, the working roller 18 is brought to rest against or magnetically pressed against both magnet rollers.

This embodiment makes the roller 18 dip into the application liquid or flowable substance which is stored in trough 43 located under the roller 18.

It is possible to provide spray nozzles 44 instead of or as a supplement to dipping, which besides their spraying action can also provide the continuous cleaning of the working roller surface of substance traces or of impurities which are taken up by the working roller from the surface on which the application process is performed and which are not supposed to be transferred back to the application surface, nor to stick to the surface of the working roller, since this could disturb the operation.

It is shown in broken lines that the magnets 2, 3 in the rollers 21, 27 can be swung into an upper position and that a working roller 18 can be inserted above the two magnet rollers 21, 27, similar to the arrangement shown in FIG. 16.

When the working roller 18 is arranged underneath, the web of material moves preferably in the direction of arrow 46.

In the travel direction 46, whereby the magnet roller 27 is removed, the working roller can be stripped or predosed with the aid of the surface 47 of the carrier 43; in this case the surface 47 carries out the same functions as plate 23, roller 24, roller 27, respectively surface 3, etc.

Just like all the other illustrated embodiments, FIG. 17 can also be represented in other spatial arrangement with minimal adjustments.

I claim:

1. A process for controlling wetting of a web with a flowable substance, said process comprising the steps of:

(a) providing at least one roller with a body of a compressible material capable of absorbing a flowable substance adapted to wet a web upon relaxation of pressure upon said material and capable of releasing said flowable substance from said material upon compression and squeezing thereof, said body of compressible material being in contact with said web over an entire width thereof and forming a continuous periphery of said roller;

(b) rotating said roller in contact with said web and applying pressure between said web and said roller at a first location around said periphery of said roller where said body of said roller contacts said web sufficiently to controllably compress said body at said location;

(c) applying pressure to said body during rotation thereof at at least one further location about said periphery of said roller sufficiently to squeeze said flowable substance at least in part out of said body so that the pressure applied to said body at said locations controls a quantity of the flowable substance remaining on said web as said web passes said first location; and (d) impregnating said body with said flowable substance at a location upstream in rotation of said roller and said body of said further location, whereby a portion of the flowable substance is squeezed from said body at said further location and another portion of said flowable substance is transferred to said web by said body at said first location, the pressure applied to said body at said further location being applied by pressing a surface against said body defining with said periphery a wedge-shaped space, the impregnating of said body further comprising feeding said flowable substance to said wedge-shaped space.

2. The process defined in claim 1 wherein the pressure applied to said body at said first location is generated at least in part by magnetically drawing said roller toward a counter-surface supporting said web at said first location.

3. The process defined in claim 1 wherein the pressure applied to said body at said further location is generated by magnetically drawing another roller thereagainst.

4. The process defined in claim 1 wherein said surface pressed against said body is another roller, said process further comprising the step of rotating said rollers in opposite senses.

5. The process defined in claim 1 wherein pressure is applied to said body at a plurality of said further locations spaced around said periphery.

6. A process for applying a flowable substance on a surface to be wetted, said process comprising the steps of:

(a) providing a working roller with an absorbing jacket having an outer circumference over an entire application width of said roller;

(b) moving said working roller in a direction of rotation;

(c) impregnating said absorbing jacket with a flowable substance, thereby storing and transporting said flowable substance to a surface to be wetted; and (d) pressing said working roller circumferentially against a supporting surface extending over said entire width upstream of said application zone, thereby compressing said circumference of said jacket for predosing an amount of said substance to be delivered to said application zone;

(e) thereafter controllably pressing said roller against the surface to be wetted juxtaposed with said outer circumference in said application zone, thereby transferring a predetermined amount of said flowable liquid between said roller and said surface upon compressing of said jacket;

(f) thereafter relaxing said circumference of said jacket; and (g) thereafter compressing said circumference of said jacket upon encountering a countersurface downstream of said application zone, thereby removing at least a part of said substance left in said jacket upon applying of said substance to said surface to be wetted.

7. The process defined in claim 6 wherein said pressing of said roller against said surfaces to be wetted is performed by a magnetic force.

8. The process defined 7, further comprising the step of selectively controlling said magnetic force over said application width.

9. The process defined in claim 6, further comprising the step of cleaning said circumference of said jacket upstream of said countersurface.

* * * * *